United States Patent [19]

Sela

[11] Patent Number: 5,002,273

[45] Date of Patent: Mar. 26, 1991

[54] DEVICE PARTICULARLY USEFUL FOR TRAINING PLAYERS OF A GAME SUCH AS BASKETBALL

[76] Inventor: Ilan Sela, Kadish Luz St. 9/15, Ramot Sapir, Haifa, Israel

[21] Appl. No.: 389,938

[22] Filed: Aug. 7, 1989

[51] Int. Cl.[5] ..... A63B 69/00

[52] U.S. Cl. ..... 273/1.5 A; 434/248; 434/255

[58] Field of Search ..... 273/1.5 A, DIG. 30, 273/55 C, 189 R, DIG. 19, 183 B, 183 R, 188 R; 272/902; 434/247, 255, 248; 128/878

[56] References Cited

U.S. PATENT DOCUMENTS

| | | | |
|---|---|---|---|
| 2,860,424 | 11/1958 | McKinnon | 434/255 |
| 3,973,333 | 8/1976 | Caris | 273/DIG. 30 X |
| 4,214,382 | 7/1980 | Matsutani | 434/247 |
| 4,359,221 | 11/1982 | Taylor | 273/189 R X |
| 4,422,455 | 12/1983 | Olsen | 128/878 |
| 4,651,989 | 3/1987 | Wilson | 273/55 C |
| 4,688,564 | 8/1987 | Kelly | 128/878 |
| 4,757,995 | 7/1988 | Gallagher | 434/255 |

*Primary Examiner*—Paul E. Shapiro
*Attorney, Agent, or Firm*—Benjamin J. Barish

[57] ABSTRACT

A training device for training one player of a game, such as basketball, to closely follow another player of the game, comprises a body-worn member to be worn by the one player; a tether fixed at one end to the body-worn member; and a quickly attachable-detachable connector element carried at the opposite end of the tether for attachment to a mating connector element carried by another training device to be worn by another player.

5 Claims, 1 Drawing Sheet

FIG 1
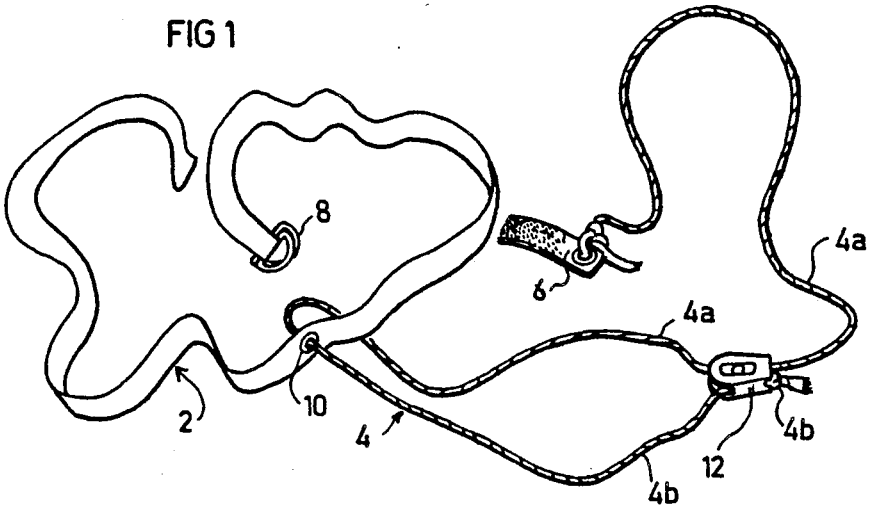
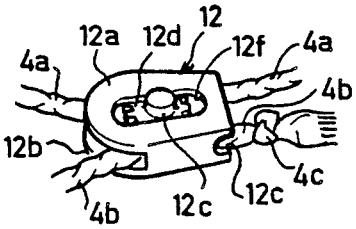
FIG 5
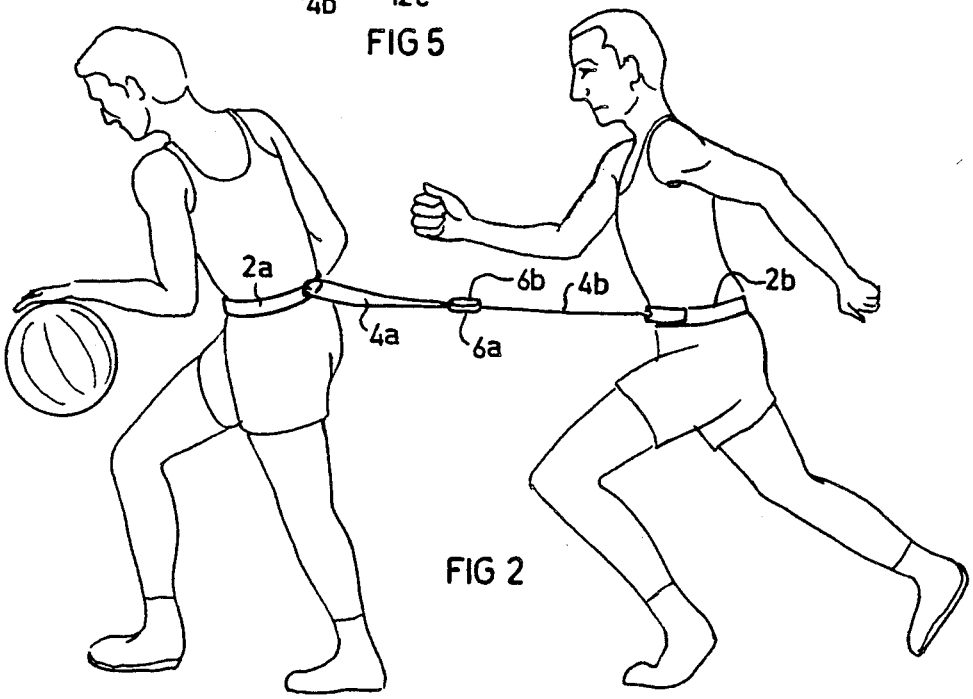
FIG 2
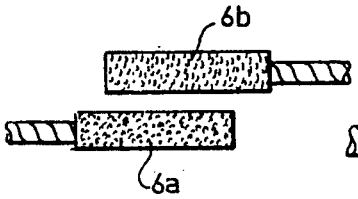
FIG 3
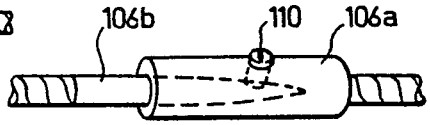
FIG 4

DEVICE PARTICULARLY USEFUL FOR TRAINING PLAYERS OF A GAME SUCH AS BASKETBALL

FIELD AND BACKGROUND OF THE INVENTION

The present invention relates to a training or amusement device, and particularly to one useful for training one player of a game, such as basketball, to closely follow another player of the game. The invention is described below with respect to basketball training, but it will be appreciated that it could be used in other games, such as soccer and hockey, and also for other purposes, such as a simple amusement device.

Many games, e.g., basketball, require one player, usually on the defence, to closely follow the movements of another player, usually on the offence. At the present time, there is no effective way of forcing the one player (the follower) to closely follow the other player (the leader), or of providing a clear indication when the follower player fails to closely follow the leader player

OBJECTS AND BRIEF SUMMARY OF THE INVENTION

An object of the present invention is to provide a training device particularly useful to force one player of a game, such as basketball, to closely follow another player of a game, and to provide a clear indication when the follower player fails to do this. Another object of the invention is to provide a device which can also be used as an amusement device for playing "follow-the-leader" type games According to the present invention, there is provided a pair of training devices for training one player of a game, such as basketball, to closely follow another player of the game according to selected training exercises. Each of the training devices comprises: a waist belt dimensioned to be worm by one player around the player's waist; a flexible tether fixed at one end to the waist belt, the tether including an extension device permitting the length of the tether to be adjusted and fixed according to a particular training exercise; and a quickly attachable-detachable connector element carried at the opposite end of the tether for attachment to a mating connector element carried by the other training device to be worm by the other player. Thus, when each of the two players wears one of these training devices, and the connector element of one device is attached to the connector element of the other, the player assuming the "follower" role is forced to closely follow the player assuming the "leader" role in order to prevent detachment of the connector, and any failure in this is quickly indicated by the detachment of the connector elements.

In one preferred embodiment described below, the quickly attachable-detachable connector element is one element of a loop-and-hook fabric connector, such as that sold under the trademark "Velcron" (Reg. T.M.). In another described embodiment, the quickly attachable-detachable connector element is one element of a cylinder-and-piston plastic connector. Preferably, the latter connector includes a noise-maker to make a noise when the two connector elements become detached, to thereby provide an audible indication when the follower player fails to closely follow the leader player.

Further features and advantages of the invention will be apparent from the description below

BRIEF DESCRIPTION OF THE DRAWINGS

The invention is herein described, by way of example only, with reference to the accompanying drawings, wherein FIG. 1 illustrates one form of training device constructed in accordance with the present invention;

FIG. 2 illustrates the adjustable element in the training device of FIG. 1 for making the tether adjustable in length;

FIG. 3 illustrates the quickly attachable-detachable connector elements carried at the ends of the tethers of two such training devices;

FIG. 4 illustrates another form of quickly attachable-detachable connector which may be used, particularlY one including a noise maker effective to make a noise when the connector elements are detached; and FIG. 5 illustrates the manner of using two of the training devices for training players in the game of basketball.

DESCRIPTION OF A PREFERRED EMBODIMENT

The device illustrated in the drawings is particularly useful as a training device for training one player of a game (hereinafter called the "follower") to closely follow another player (hereinafter called the "leader"). The drawings illustrate the training device being used in training for playing the game of basketball, but it will be appreciated that it could be used for training in playing other games, such as soccer, hockey, etc., particularly where the leader is on the offence and the follower is on the defence and is to closely follow the leader.

The illustrated training device comprises a body-worn member in the form of a belt, generally designated 2, a tether cord 4 fixed at one end to the belt 2, and a quickly attachable-detachable connector element 6 carried at the opposite end of the tether cord 4. Connector element 6, in the embodiment illustrated in FIGS. 1 and 4 is one element of a loop-and-hook fabric connector, such as the connector sold under the trademark "Velcron" (Reg. T.M.), and is adapted to be quickly attachable to, and detachable from, a mating connector element carried by another training device to be worn by another player This is shown in FIG. 5 which illustrates two basketball players each wearing a belt 2*a*, 2*b* including a tether cord 4*a*, 4*b* carrying one of the quickly attachable-detachable connector elements 6*a*, 6*b*.

Belt 2 may be a plain fabric belt formed with a conventional buckle 8 at one end to permit the belt to be applied around the waist of the respective player, as shown in FIG. 5 Tether 4 is a cord of fabric, plastic or rope material passed through an opening 10 in the belt 2, the two ends of the tether cord passing through an extension device 12 permitting the length of the tether cord to be adjusted as desired. The end of tether cord 4 opposite to that attached to belt 2 carries the connector element 6.

Extension device 12 may be of any known construction. For purposes of example, it is shown as including a housing 12*a* open at its opposite ends 12*b*, 12*c* for receiving the two ends 4*a*, 4*b* of the tether cord. End 4*b* of the tether cord is knotted, as shown at 4*c*, to prevent its inadvertent withdrawal from housing 12*a*, whereas the end 4*a* of the tether cord passes through housing openings 12*b*, 12*c* and carries the connector element 6 at its end.

Housing 12*a* of extension device 12 includes a toothed wheel 12*d* slidable longitudinally of the housing and guided for sliding movement by a pin 12*e* movable within an elongated slot 12*f* formed in one wall of the housing. The housing 12*a* decreases in width from its opening 12*b* to its opening 12*c*. The tooth wheel 12*d* is of a diameter such that when it is located next to opening 12*b* it permits free passage of the cord ends 4*a*, 4*b* in either direction, whereas when it is moved to the end of the housing (rightwardly, FIG. 2*a*) towards opening 12*c*, it wedges the two cord ends 4*a*, 4*b* between it and the inner face of the housing, thereby locking the cord ends from movement.

Accordingly, whenever it is desired to change the length of the tether cord 4, this may easily be done by moving pin 12*e* of the tooth wheel 12*d* towards the wider end of housing 12*a* (leftwardly, FIG. 2) occupied by opening 12*b*, whereupon either of the two ends 4*a*, 4*b* of the cord may be moved in either direction through the housing. When it is desired to fix the length of the tether cord, pin 12*e* is moved in the opposite direction (rightwardly, FIG. 2) towards opening 12*c*, to lock, by a wedging action, the cord ends from movement in either direction.

The manner of using the training device illustrated in FIGS. 1–4 is shown in FIG. 5. Thus, each of the two players wears one of the training, devices, each player applYing the belt 2*a*, 2*b* of his (or her) respective playing device around the waist. The length of the tether cord 4 may be adjusted, by adjusting device 12, according to the particular training exercise; thus, shortening the length of the tether cord 4 more severely requires the follower player, wearing belt 2*b*, to closely follow the leader player, wearing the belt 2*a*. After the tether cords 4 have been adjusted and fixed to the required length, the connector element 6*a* of one training device is pressed against the connector element 6*b* of the other training device, to effect the quickly attachable-detachable connection between the two training devices.

The follower player wearing belt 2*b* is required to closely follow all the movements of the leader player wearing belt 2*a* in order to avoid detachment of the two connector elements 6*a*, 6*b*. Such a training exercise is particularly useful in games, such as basketball, soccer and hockey, for training players when on the defence against a player on the offence.

FIG. 4 illustrates a variation in the construction of the quickly attachable-detachable connector elements, therein designated 106*a*, 106*b*, which may be applied at the ends of the tether cords in the two training devices. Thus, instead of using a loop-and-hook fabric connector, as illustrated particularly in FIG. 3, there is used a cylinder-and-piston plastic connector, in which one element, 106*a*, is in the form of a cylinder adapted to receive a sliding piston connector element 106*b*. When the piston element 106*b* becomes detached from the cylinder element 106*a*, a "pop" sound is heard by the rush of air into cylinder element 106*a*. Such a sound or noise provides a clear audible indication when the follower player has failed to closely follow the leader player causing the two detector elements to become detached. If desired, the connector may include a further sound maker, of the air-blown type such as shown at 110, to produce a louder audible sound when the two detector elements become detached.

While the invention has been described with respect to two preferred embodiments, it will be appreciated that many other variations, modifications and applications of the invention may be made.

What is claimed is:

1. A pair of training devices for training one player of a game to closely follow another player of the game according to selected training exercises, each of said training devices comprising:

a waist belt dimensioned to be worn by each player around the player's waist;

and a tether of adjustable length fixed at one end of the waist belt of each device;

each of said tethers including an extension permitting the length of its respective tether to be adjusted and fixed according to a particular training exercise;

the opposite end of one tether carrying a single connector element of one type, and the opposite end of the other tether carrying a single connector element of another type which is quickly attachable to and detachable from the connector element of the one tether, whereby when two players wear the training devices and have their tethers attached to each other via their respective connector elements, one player is required to closely follow the body movements of the other player to avoid detachment of the two tethers.

2. The training device according to claim 1, wherein each of said tethers is a cord attached to its respective waist belt.

3. The training device according to claim 1, wherein each of said quickly attachable-detachable connector elements is one element of a loop-and-hook fabric connector.

4. The training device according to claim 1, wherein each of said quickly attachable-detachable connector elements is one element of a cylinder-and-piston plastic connector.

5. The training device according to claim 1, wherein one of said quickly-attachable connector elements includes a noise-maker to make a noise when the connector element becomes detached from the connector element of the training device worn by the another player.

* * * * *